United States Patent [19]

Shults

[11] 3,953,091

[45] Apr. 27, 1976

[54] MECHANIZED SERVICE BAR

[76] Inventor: George D. Shults, 1510-79th Ave. North, St. Petersburg, Fla. 33702

[22] Filed: Sept. 30, 1974

[21] Appl. No.: 510,763

[52] U.S. Cl. ..... 312/223; 312/239; 186/1 R; 108/22; 52/31

[51] Int. Cl.[2] ..... A47B 77/08

[58] Field of Search ..... 312/201, 196, 140.1, 312/239, 223; 186/1 D; 108/22; 52/31

[56] References Cited

UNITED STATES PATENTS

| | | | |
|---|---|---|---|
| 2,277,929 | 3/1942 | Meyer | 312/239 |
| 2,644,567 | 7/1953 | Springer | 108/22 X |
| 2,815,539 | 12/1957 | Schneider | 52/31 |
| 2,883,627 | 4/1959 | Jente | 186/1 D |
| 2,970,874 | 2/1961 | Honeycutt et al. | 312/223 |
| 2,995,408 | 8/1961 | Kobrin | 312/239 |
| 3,039,565 | 6/1962 | Egner | 186/1 D |
| 3,056,506 | 10/1962 | Fuller et al. | 312/196 |
| 3,297,107 | 1/1967 | Shipp | 186/1 |

*Primary Examiner*—Robert L. Wolfe
*Assistant Examiner*—Victor N. Sakran
*Attorney, Agent, or Firm*—Harness, Dickey & Pierce

[57] ABSTRACT

A mechanized service bar and serving system consisting of a service counter adapted to accommodate a plurality of patrons at spaced serving stations therealong, and a carriage mounted for guided movement along a path adjacent to the service counter having an operating station thereon adapted to be occupied by a service attendant or carriage operator. The carriage is provided with an adequate supply of items to be served which are adapted to be dispensed by the service attendant. Movement of the carriage in either direction is controlled by the service attendant and suitable signal means are provided at the service stations for communicating to the service attendant, those stations at which service is desired. The carriage further includes a cash register for handling the purchase of dispensed items by patrons, and preferably further includes a platform for accommodating entertainment personnel as may be desired.

19 Claims, 6 Drawing Figures

12
30
32
34
36
38
40
42
44
46
48
50
52
54
60
62
64
66
68
70
72
74
76
78
80
82
84
86
88
90
92
94
96
98
100
102
104
106
108
110
112
114
116
118
120
122
124
126
128
130
132
134
136
138
140
142

MECHANIZED SERVICE BAR

BACKGROUND OF THE INVENTION

A variety of methods and devices have heretofore been used or proposed for increasing the efficiency in serving customers and patrons in various food and beverage establishments. Unfortunately, prior art systems and devices have not been successful for one or a combination of reasons, not least among which has been the high cost and/or complexity of automatic serving systems and the absence of any significant increase in efficiency over conventional manual servicing techniques.

The present invention comprises a breakthrough in the art of providing personalized services to patrons seated at a counter, achieving a three-fold increase in the efficiency of the service attendant, while at the same time providing quicker and better service to the patrons. In accordance with its structural aspects, the hydrostatic drive system for propelling the service carriage in either direction is extremely reliable, practiacally noise-free and requires only minimal maintenance and service during use. Moreover, the mechanized service bar system of the present invention is versatile in design and readily adaptable for the mechanization of existing conventional manual service counters at reasonable costs and within reasonable installation periods.

SUMMARY OF THE INVENTION

The benefits and advantages of the novel mechanized service bar and method of dispensing items to patrons seated along a service counter is achieved in accordance with the present invention by providing a service carriage mounted for movement along a path adjacent to a service counter along which patrons are seated at spaced intervals therealong. The carriage is equipped with storage facilities for storing an adequate quantity of the items to be dispensed to the patrons and further includes a cash register operable by the service attendant or carriage operator for handling the money transactions in connection with the purchase of dispensable items by the patrons. The carriage is provided with an operating station which includes actuatable means thereon selectively actuatable by the service attendant for controlling the direction and speed of the carriage along the service counter. Each of the service stations are preferably provided with a suitable signal device adapted to be energized by a patron at that service station which is effective to visually or audibly communicate to the service attendant the location of the service station desiring service.

A particularly preferred embodiment of the present invention includes the provision of a circular service counter and a carriage pivotally mounted on a pedestal at the center of the counter for rotation in either direction along a path adjacent to the inner edge of the counter, and wherein the carriage is propelled with a reliable hydrostatic reversible drive unit controlled by the carriage operator and contained within a rotatable carriage framework.

Additional benefits and advantages of the present invention will become apparent upon a reading of the description of the preferred embodiments taken in conjunction with the accompanying drawings.

DESCRIPTION OF THE PREFERRED EMBODIMENTS

Figure 1:
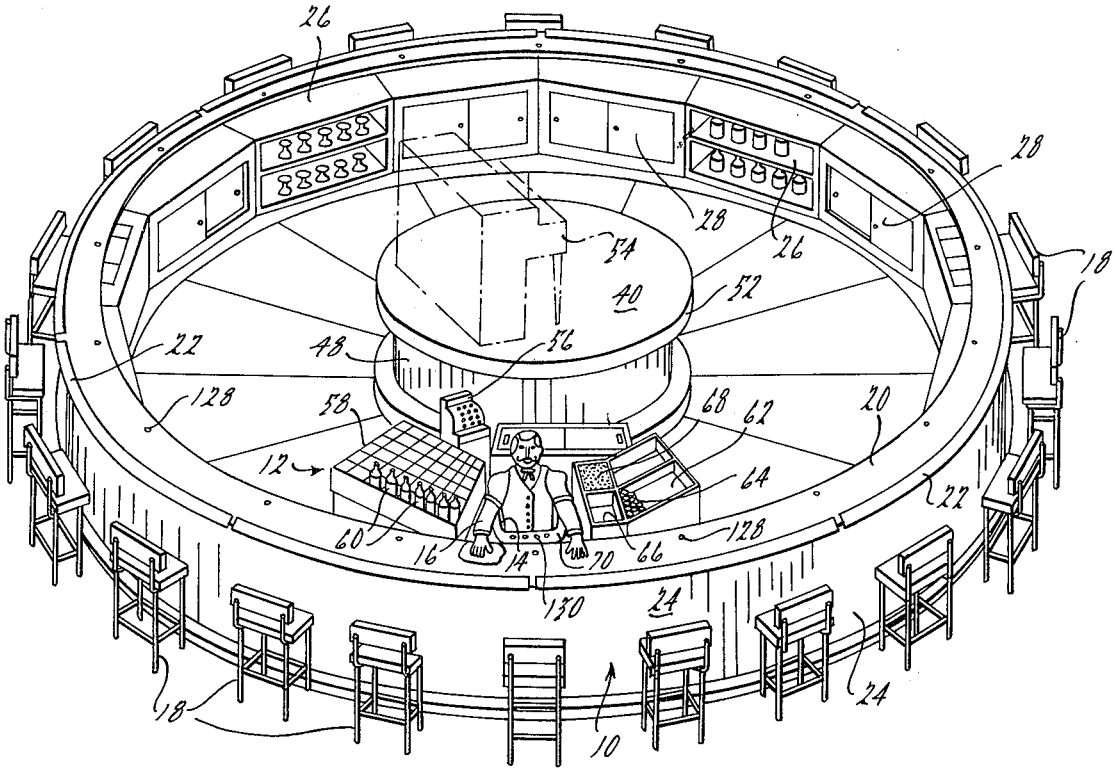
FIG. 1 is a perspective view of a mechanized service bar comprising a circular service counter and a carriage mounted for rotating movement around the interior thereof.

Referring now in detail to the drawings and as best seen in FIG. 1, a mechanized bar system in accordance with one embodiment of the present invention comprises a circular service counter 10, having a rotatably mounted carriage 12 disposed within the interior thereof and formed with an operating station, indicated at 14, at which a service attendant or bartender 16 is adapted to be stationed for serving patrons disposed at circumferentially spaced locations around the outer periphery of the counter. In the exemplary embodiment shown in FIG. 1, the service stations along the circular counter correspond approximately to the positions occupied by the chairs or stools 18, which provide a seating capacity of 20 customers.

The service counter 10 may comprise any one of a variety of suitable constructions, including a horizontal arcuately-extending bar top portion 20, suitably provided with a padded rail 22 along the upper outer edge thereof and a padded outer wall 24 finished in a desired decorative trim to provide a preselected aesthetic appearance. The inner suface of the bar is defined by a series of cabinets including shelf cabinets 26 and door cabinets 28, which are adapted to store an auxiliary supply of material and equipment, such as beverages and glassware, augmenting the supply stored on the carriage itself.

Figure 2:
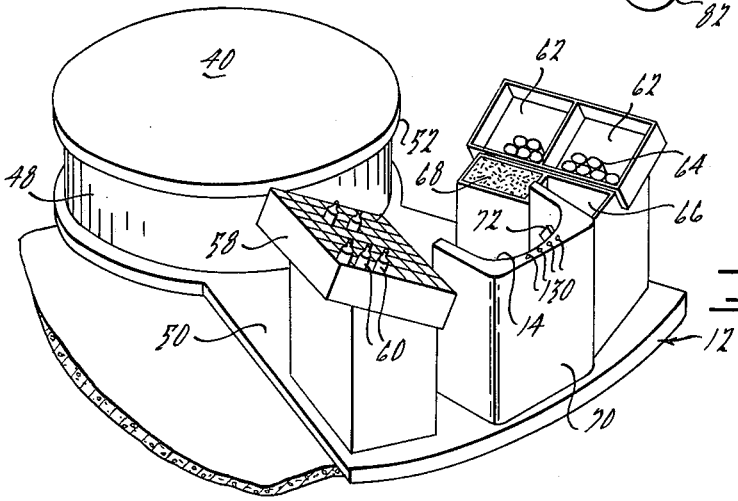
FIG. 2 is a fragmentary perspective view of the carriage of the mechanized service bar shown in FIG. 1 and illustrating in particular the carriage operating station and the storage supply means accessible to the carriage operator.
Figures 4, 5, 6, 7:
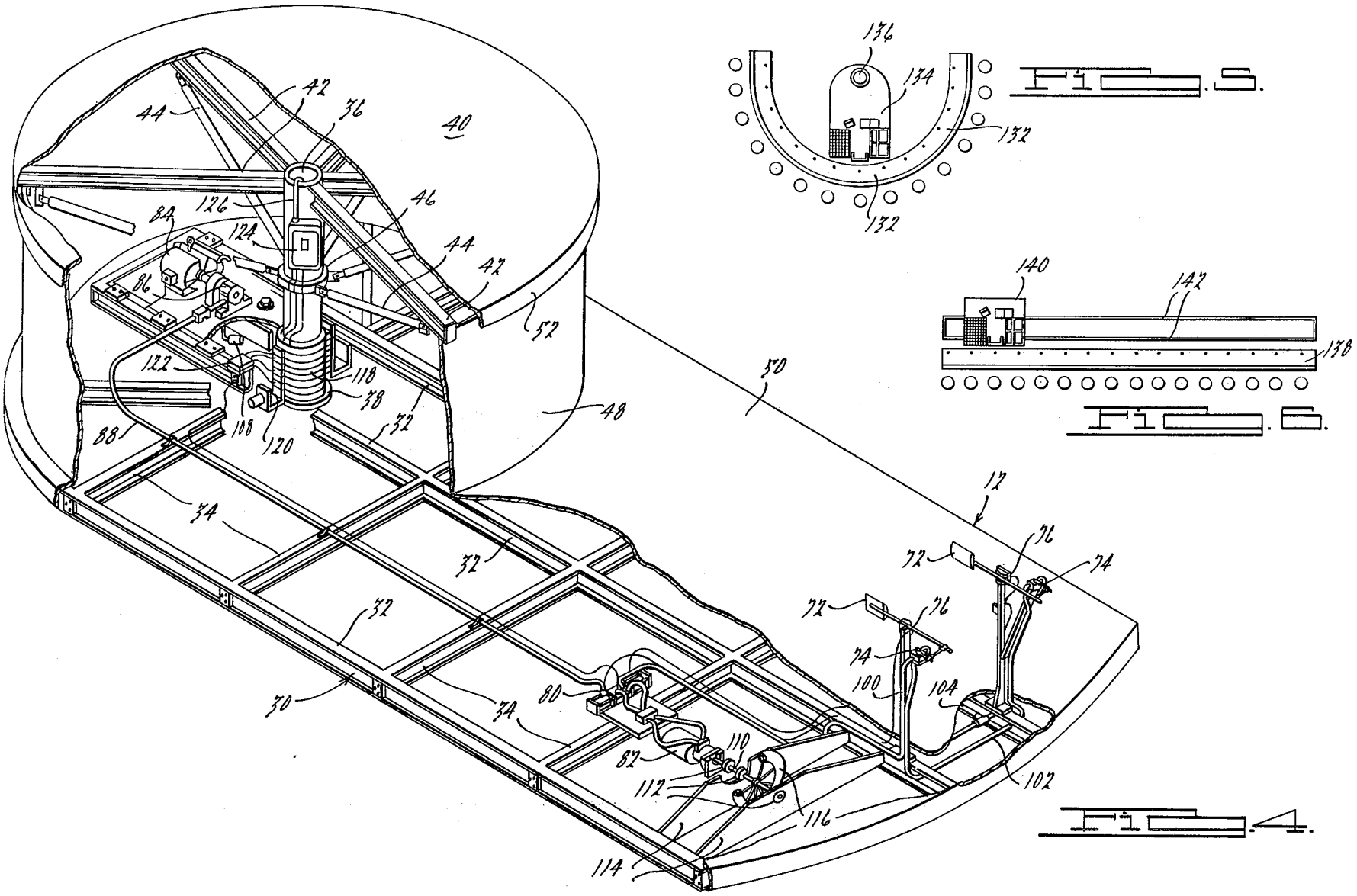
FIG. 4 is a fragmentary perspective view, with portions thereof broken away exposing the interior of the carriage framework and the disposition of the control and drive elements therefor.
FIG. 5 is a plan view of a mechanized service bar employing a substantially U-shaped service counter in lieu of a circular service counter as shown in FIG. 1.
FIG. 6 is a plan view of still another alternative satisfactory embodiment of the present invention illustrating a mechanized service bar having a straight service counter along which the carriage is adapted to travel.

The carriage, as best seen in FIGS. 1, 2 and 4, is comprised of a framework consisting of a base 30, formed by a series of longitudinally extending I-beams 32 interconnected to cross I-beams 34, which is pivotally supported on a central pedestal or post 36 by means of an antifriction bearing 38. A circular platform or stage 40 is supported by a series of radially extending beams 42 affixed at their inner ends to the upper portion of the central pedestal 36 and are further rigidified by angular braces 44 secured at their lower inner ends to a collar 46 secured to the center post. A cylindrical shroud 48 extends upwardly from a floor panel 50 on the base to a position beneath and inwardly of a cylindrically depending flange 52 extending around the periphery of the stage 40. The circular platform or stage 40 is adapted to accommodate entertainment personnel, as well as their equipment, such as a piano 54 shown in phantom in FIG. 1, for entertainment of the patrons. The interior of the carriage framework beneath the platform 40 also provides an enclosed area within which some of the components of the hydrostatic drive mechanism for the carriage are located.

The forward or outer end of the carriage, as shown in FIGS. 1, 2 and 4, is arranged with an operating station adapted to be occupied by the bartender or carriage operator, who controls movement of the carriage from one service station to the next, and also dispenses the beverages or the like to customers and collects the purchase money for the items dispensed. The various supplies and equipment as shown in FIGS. 1 and 2 are conveniently located within reach of the service attendant and include a cash register 56, a rack 58 filled with a variety of bottles 60 containing beverages to be dispensed, a pair of trays 62 filled with a supply of clean glasses 64, a waste sink 66 and a compartment 68 adapted to be filled with ice cubes and other dispensable items for the convenience of the service attendant. It is also contemplated that the carriage can be equipped with an automatic or computerized drink blending apparatus to eliminate manual drink blending, thereby further increasing the efficiency of the service attendant and mechanized bar system.

Figure 3:
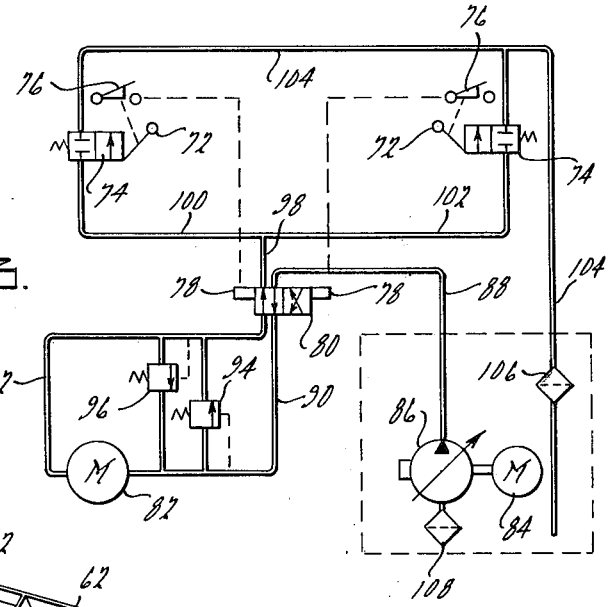
FIG. 3 is a diagrammatic view of the hydrostatic drive system and controls therefor for propelling the carriage.

The operating station 14 is defined by a generally U-shaped podium 70, which is equipped with a pair of pivotally mounted levers 72, as best seen in FIG. 4, adapted to be alternatively actuated by the leg or hip of the service attendant in response to leaning in one direction or the other to effect movement of the carriage in the desired direction. As best seen in FIGS. 3 and 4, each lever 72 is operatively connected to a flow control valve 74, which controls the volume of hydraulic fluid passing therethrough as a function of the magnitude of deflection of the lever 72. In addition, a microswitch 76 is operatively associated with each lever 72 and is actuatable in response to movement of the lever from the unactuated position. The microswitch 76 is electrically connected, as shown by the dotted line in FIG. 3, to a solenoid 78 of a four-way solenoid-operated directional valve 80, which is operable to control the direction of flow of hydraulic fluid to a reversible hydraulic motor 82, and thereby control the direction of movement of the carriage.

The hydraulic drive system as diagrammatically shown in FIG. 3 comprises an electric motor 84 drivingly coupled to a hydraulic pump 86, the outlet side of which is connected to a pressure line or conduit 88, which is disposed in communication with the directional valve 80. Two alternating supply lines 90, 92 are connected to the reversible hydraulic motor 82 and are effective to supply a pressurized hydraulic fluid thereto, depending upon the specific position of the directional valve 80. In the specific position of the valve as shown in FIG. 3, line 90 is pressurized with line 92 comprising the discharge or return line of the hydraulic fluid after passing through the reversible motor 82. In order to control the rate of acceleration of the carriage upon actuation of either of the levers 72, a pair of cross-over relief valves 94, 96 are placed in parallel between lines 90, 92 and serve to by-pass a portion of the hydraulic fluid to the return line in response to a build-up of pressure beyond a preset maximum, avoiding thereby excessive acceleration of the carriage from a standing position.

The outlet side of the directional valve 80 is connected to a return conduit 98, having branches 100 and 102, which are connected, respectively, to flow control valves 74 at the operating station, which in turn are connected to a common return line 104, which discharges the hydraulic fluid through a return filter 106 back into the hydraulic fluid supply tank or sump. A filter 108 is connected to the suction side of the hydraulic pump 86.

The mechanical disposition of the elements diagrammatically shown in FIG. 3 is illustrated in FIG. 4 with like numerals indicating like components. As shown, the reversible hydraulic motor 82 is connected to a drive shaft 110 rotatably supported in bearings 112 secured to transverse webs 114, to which a drive wheel 116 is secured. The drive wheel 116 preferably is of a pneumatic type providing smooth and quiet acceleration and decelertion of the carriage in response to the direction and volume of flow of hydraulic fluid to the reversible drive motor. The tire of the drive wheel 116 is disposed in driving contact with the ground or other supporting platform on which the mechanized bar system is installed.

Supply of electrical energy to the three-phase electric pump motor 84 is achieved by a four-track collector ring assembly 118 stationarily secured to the base of the center post around which a four-brush assembly 120 is rotatably mounted for movement in response to the rotary movement of the carriage. Each brush is connected to an appropriate wire of the three-phase supply system, which in turn is connected to a three-phase motor control switch 122 secured to the base framework of the carriage. Electrical overload protection is provided by a three-phase circuit breaker 124, secured to the upper portion of the center post 36 to which an inlet electrical supply line 126 is electrically connected and extends downwardly through the hollow centerpost and outwardly beneath the carriage platform to a source of supply of three-phase electrical energy. In accordance with a preferred embodiment, the electrical supply system is backed up by an auxiliary power supply system in the event of a power failure or outage. The auxiliary system can be an auxiliary motor-driven generator and/or a battery power system to assure continued operation of the mechanized bar and associated equipment.

It will be apparent from the foregoing hydrostatic drive system that control of the speed and the direction of the carriage is accomplished exclusively by the service attendant in response to actuation of one or the other of the levers 72 with the magnitude of deflection establishing the speed of carriage travel as further controlled by the flow control valves 74 connected thereto. The acceleration of the carriage from a standstill position as previously mentioned is conrolled by cross-over relief valves 94, 96 (FIG. 3), avoiding thereby any abrupt changes in speed tending to cause spillage or dislocation of the supplies and equipment on the carriage proper.

Typically, a mechanized bar system of the type illustrated in FIGS. 1–4 of the drawings enables one bartender to service a circular bar which can accommodate 40 to 50 patrons, supplemented by the assistance of one or two waitresses. In accordance with prior art manual bartending techniques, three or four bartenders, in addition to the one or two waitresses, would be required to adequately service the aforementioned number of patrons. The hydrostatic drive system for optimum operation provides variable speeds up to about 5 miles per hour, enabling up to about 8 revolutions per minute of the carriage around a circular bar of a nominal diameter of about 30 feet.

In order to further facilitate efficient service to the several patrons at the service counter, suitable signal means are provided, such as buttons 128 as best shown in FIG. 1, which are operatively connected to a suitable switch. The buttons 128 are disposed at appropriate locations along the bar top, generally corresponding with each of the service stations adapted to be occupied by a patron. Upon desiring service, a patron at a service station simply depresses the button, actuating the switch means, which through a sound wave transducer, a Citizen's Band radio or through a direct electrical connection with the operating station on the carriage is operative through suitable indicating means to audibly or visually signal that service is desired at a particular location along the service counter. In this latter regard, the individual buttons and their respective location can be correlated either numerically or by the use of a color-coded lighting system, such as a series of bulbs 130 mounted on the forward end of the podium 70 to visually signal the carriage operator the specific station or, more usually, the quadrant within which a patron desires service. In the case where the signal means are directly electrically connected to the indicating means on the carriage, a suitable brush and collector ring assembly, smilar to that previously described for providing electrical power to the three-phase pump motor, is employed to permit relative movement of the carriage and the stationary serving counter. Alternatively, in the case of a sound transducer or Citizen's Band transmitter, the carriage is appropriately provided with a receiver which is responsive to a prescribed frequency or combination of frequencies to correlate and indicate the specific station or group of stations signalling for service.

In addition to a circular bar arrangement as illustrated in FIG. 1 of the drawings, it is also contemplated that alternative serving counter configurations can be accommodated to provide for a movable carriage which is movable along a guided path adjacent to one side of the serving counter. As shown in FIG. 5, an arcuate service counter 132 is illustrated, which is of a substantially semicircular or U-shaped configuration and which is serviced by a carriage 134 pivotally mounted on a center support 136 or post which is located at a point corresponding to the center of curvature of the bar or counter. In accordance with the arrangement illustrated in FIG. 5, the carriage 134 is adapted to oscillate from one end to the other end of the U-shaped service counter and its movement is controlled in the same manner as previously described in connection with FIGS. 1–4.

Similarly, the adaptation of a mechanized service bar system to a substantially straight service counter is diagrammatically illustrated in FIG. 6, in which a straight horizontal service counter 138 is provided with a longitudinally movable and reciprocable carriage 140 guidably mounted on suitable rails or tracks 142 disposed on one side of the counter. The basic distinction of the arrangement shown in FIG. 6 and that previously shown in FIGS. 1–4 is that the carriage 140 is mounted for longitudinal movement on the guide rails 142 rather than being pivotally mounted on a center post as in the previously described embodiments. In other respects, however, movement of the carriage 140 longitudinally along the straight bar 138 is achieved by a hydrostatic drive mechanism employing one or a plurality of drive wheels, the direction of rotation of which and the speed of rotation being controlled by hip levers actuatable by the carriage operator or service attendant on the carriage.

It will be appreciated that in addition to the circular, arcuate and straight service counter configurations shown in the drawings, composite configurations of service counters can be readily mechanized in accordance with the present invention consistent with any desired layout and in consideration of the available area and presence of obstructions in each particular building location.

While it will be apparent that the invention herein disclosed is well calculated to achieve the benefits and advantages set forth, it will be appreciated that the invention is susceptible to modification, variation and change without departing from the spirit thereof.

What is claimed is:

1. A mechanized service bar comprising a service counter adapted to accommodate a plurality of patrons at spaced serving stations along one side thereof, a carriage mounted for guided movement along a path immediately adjacent to other side of said service counter, an operating station on said carriage disposed at a position adjacent to said serving stations and adapted to accommodate a carriage operator, reversible drive means operably associated with said carriage propelling said carriage along said path including means controlling the acceleration and deceleration of said carriage from and to a stationary position, actuating means on said carriage disposed at said operating station selectively actuatable by a carriage operator for controlling said reversible drive means and the direction and speed of travel of said carriage, and storage means on said carriage accessible from said operating station for storing a supply of dispensable items for dispensing by the carriage operator directly to the patrons at said serving stations along said service counter.

2. The service bar as defined in claim 1, further including signal means at each of the service stations selectively energizable by a patron at such station desiring service and indicating means on said carriage for communicating the energization of said signal means to the carriage operator.

3. The service bar as defined in claim 1, in which said carriage further includes a cash register for collection of payments from the patrons for the items purchased.

4. The service bar as defined in claim 1, wherein said service counter includes auxiliary storage means along the side adjacent to said path of travel of said carriage and accessible to the carriage operator thereon for supplementing the supply of said storage means on said carriage.

5. The service bar as defined in claim 1, wherein said service counter is of an arcuate configuration.

6. The service bar as defined in claim 1, wherein said service counter is formed in the shape of a circular arc and said carriage is pivotally mounted for arcuate travel about a point corresponding to the center of said circular arc.

7. The service bar as defined in claim 6, wherein said counter is in the form of a complete circle.

8. The service bar as defined in claim 6, wherein said counter is substantially in the form of a semi-circle.

9. The service bar as defined in claim 1, wherein said carriage further includes a platform thereon for accommodating entertainment personnel.

10. The service bar as defined in claim 2, wherein said signal means are coupled to said indicating means by electromagnetic waves.

11. The service bar as defined in claim 2, wherein said signal means are coupled to said indicating means by sound waves.

12. The service bar as defined in claim 2, wherein said signal means comprises switch means located at each service station and selectively actuatable by a patron and said indicating means are operable to visually indicate the actuation of said switch means to the carriage operator.

13. The service bar as defined in claim 12, wherein said indicating means comprises an illuminable light.

14. The service bar as defined in claim 13, wherein said illuminable light is color-coded in correlation with the location of the actuated said switch means.

15. The service bar as defined in claim 1, wherein said reversible drive means includes a hydraulic motor drivingly coupld to a drive wheel disposed in driving contact with the platform on which said service bar is supported, and a directional flow control valve positionable by said control means for controlling the direction of rotation of said hydraulic motor and said drive wheel.

16. The service bar as defined in claim 15, further including valve means for controlling the flow of fluid to said hydraulic motor for controlling the acceleration of said carriage.

17. The service bar as defined in claim 1, wherein said actuating means comprises a pair of spaced apart levers disposed at each side of said operating station on said carriage adapted to be occupied by a carriage operator, one of said levers operable for controlling movement of said carriage in one direction and the other of said levers operable for controlling movement of said carriage in the opposite direction, each of said levers selectively actuatable by contact with the body of the carriage operator and operative to signal said control means.

18. The service bar as defined in claim 17, wherein said reversible drive means includes hydraulic motor means and each of said levers are operatively connected to a flow control valve for controlling flow of hydraulic fluid to said motor means.

19. The service bar as defined in claim 18, further including a solenoid actuated directional flow control valve for controlling the direction of rotation of said motor means and the direction of travel of said carriage, and switch means operatively connected to each of said levers and actuatable thereby for energizing said solenoid actuated directional flow control valve and placing it in the proper position.

* * * * *